US006626394B1

(12) United States Patent
Kojo et al.

(10) Patent No.: US 6,626,394 B1
(45) Date of Patent: Sep. 30, 2003

(54) METHOD AND DEVICE IN THE PROCESS OF REELING UP A PAPER WEB

(75) Inventors: Teppo Kojo, Mäntsälä (FI); Janne Veräjänkorva, Espoo (FI)

(73) Assignee: Metso Paper, Inc., Helsinki (FI)

( * ) Notice: Subject to any disclaimer, the term of this patent is extended or adjusted under 35 U.S.C. 154(b) by 0 days.

(21) Appl. No.: 10/018,491

(22) PCT Filed: Apr. 28, 2000

(86) PCT No.: PCT/FI00/00384

§ 371 (c)(1),
(2), (4) Date: Oct. 30, 2001

(87) PCT Pub. No.: WO00/66471

PCT Pub. Date: Nov. 9, 2000

(30) Foreign Application Priority Data

Apr. 30, 1999 (FI) ..... 990982

(51) Int. Cl.[7] ..... B65H 18/26
(52) U.S. Cl. ..... 242/547; 242/540
(58) Field of Search ..... 242/540, 547

(56) References Cited

U.S. PATENT DOCUMENTS 5,967,449 A 10/1999 Thomas et al. ..... 242/541.1
5,988,557 A 11/1999 Möller et al. ..... 242/532

FOREIGN PATENT DOCUMENTS

DE 29811053 10/1998

*Primary Examiner*—John Q. Nguyen
(74) *Attorney, Agent, or Firm*—Steinberg & Raskin, P.C.

(57) ABSTRACT

The invention relates to a method and apparatus in a reeling process of a paper web. A paper web (PR) is continuously reeled around a reeling core (10) via a roll assembly (T). A first press device arrangement (8) is arranged to move with respect to the frame (16) of the reel-up and by means of the first press device arrangement (8) a first nip contact (N1) is maintained to the paper web (PR) that is being formed on the reeling core, and the first press device arrangement (8) is transferred with respect to the frame (16) of the reel-up into a nip contact (N2) with a second press device arrangement (11). According to the invention, the section of the roll assembly (T) before the first press device arrangement (8) and the first press arrangement (8) are formed as separate units. The paper web (PR) is guided immediately into nip contact (N1) in the first press device arrangement (8) via the roll assembly (T) stationary with respect to the frame (16) of the reel-up. Furthermore, the paper reel (5) that is being formed and the first press device assembly are transferred as a combination substantially in the travel direction of the paper web (PR) in a position controlled manner.

32 Claims, 6 Drawing Sheets

METHOD AND DEVICE IN THE PROCESS OF REELING UP A PAPER WEB

FIELD OF THE INVENTION

The invention relates to a method in the process of reeling a paper web, wherein

- the paper web is continuously reeled around an exchangeable reeling core rotating with respect to the frame of a reel-up applying the reeling process,
- the paper web is guided to a reeling core via a roll assembly
- a first press device arrangement is arranged to move with respect to the frame of the reel-up,
- by means of the first press device arrangement a first nip contact is maintained to the paper web formed on the reeling core, and the first press device arrangement is transferred with respect to the frame of the reel-up, and
- by maintaining the first nip contact established by means of the first press device arrangement, the paper reel formed on the reeling core is brought into a second nip contact with a second press device arrangement.

BACKGROUND OF THE INVENTION

The above-presented method in the reeling process for a paper web is disclosed in the publication EP-792829. In this publication, the first press device arrangement as well as the control roll assembly of the paper web, especially the final part of the same, is connected to a carriage moving in the machine direction, wherein the first press device arrangement is utilized to maintain a nip contact to the paper reel that is being formed, and said paper reel is transferred in the machine direction in contact with the second press device arrangement, which participates in the process of stopping-the full paper reel. The construction applying the method is relatively complex and heavy, because it is difficult to move the carriage and the roll assemblies to be connected thereto. Furthermore, the adjustment of the intensity of the nip contact is especially difficult in such a combination of devices.

OBJECTS AND SUMMARY OF THE INVENTION

The purpose of the invention is to introduce an improvement to the problems in the method of prior art, thus enhancing the state of art prevailing in the field. To attain the above-presented objectives, the method according to the invention is primarily characterized in that

- in a manner known as such, the section of the roll assembly before the first press device arrangement and the first press device arrangement are established as separate units,
- in a manner known as such the paper web is guided via a roll assembly which is arranged stationary with respect to the frame of the reel-up immediately into a nip contact in the first press device arrangement, and
- the paper reel that is being formed and the first press device arrangement are transferred as a combination in the travel direction of the paper web in a position controlled manner.

The publication DE-29811053 U1 discloses a reeling up method, in which the first press device arrangement and the roll assembly are established as separate units, and in which the roll assembly is arranged stationary with respect to the frame of the reel-up. However, in this publication the distance between the last roll of the roll assembly and the first nip contact is kept constant during the entire reeling up process. Thus, it is not possible to attain the advantage which is attained when the distance between the first nip contact and the last roll of the roll assembly grows in a position controlled manner, (i.e. the position of the paper reel that is being formed is altered in the machine direction in accordance with a predetermined control manner (continuous and/or discontinuous) e.g. according to the diameter) when the paper reel that is being formed and the first press device arrangement are transferred as a combination in the travel direction of the paper web.

Thus, the method makes it possible that the paper web that is being formed can be transferred in the machine direction in contact with the second press device assembly establishing the second nip contact, so that the first nip contact is maintained, wherein the first press device arrangement can be returned to the reel change station, to which a new reeling core is brought from the reeling core storage, and the end of the paper web is cut and the reeling is started on a new reeling core. Because only the first press device maintaining the first nip contact is transferred in the machine direction together with the paper reel that is being formed, the construction is light in weight and it is easier to control the strength of the nip contact.

Furthermore, another advantage attained by means of the invention is the improved control of the nip load. In the method according to the invention, the first nip contact is utilized to control/establish a so-called reeling nip, by means of which the quality of the paper reel is affected substantially. In the method the first press device arrangement is thus loaded against the reel that is being formed. Advantageously, in the method the direction of this loading force deviates substantially (advantageously 60° to 120°) from the travel direction of the paper reel that is being formed when it is transferred in a position controlled manner.

BRIEF DESCRIPTION OF THE DRAWINGS

In the following description the invention will be described in-more detail with reference to the appended drawings. In the drawings

DETAILED DESCRIPTION OF THE INVENTION

With reference to FIGS. 1*a* to *e*, the following main parts are used in the reel-up applying the method according to the invention. The reel-up comprises a horizontal reeling plane 1 which belongs to the frame of the reel-up and advantageously comprises adjacent rails or the like, on which the reeling cores can roll by means of their bearing housings. The first end 1*a* of the reeling plane 1 is provided with a reeling core storage 2, in which the reeling cores 3*a*, 3*b*, 3*c* . . . , which are arranged to enter the reeling up stage next, are located successively on the support of the reeling plane 1, and each of them in turn can be connected to the reeling carriage 4.

Below the reeling up storage 2 there is a roll assembly T (6, 7*a*, 7*b*) for transferring the paper web PR via the roll assembly T to the paper reel 5 that is being formed (the travel direction of the paper web PR is marked with an arrow K in FIGS. 1*a* to *e*).

Figure 1A:
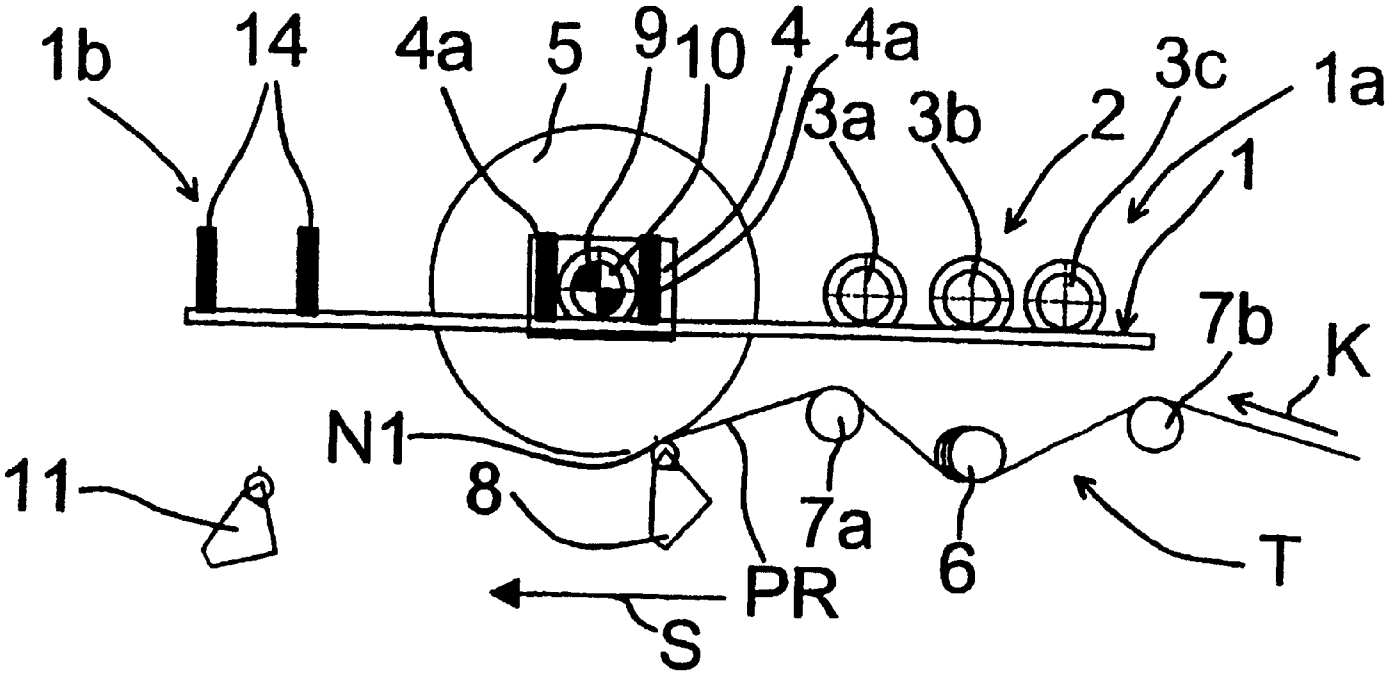
FIGS. 1*a* to *e* show the stages of applying the invention in a schematical side-view.

The roll assembly T is composed of three rolls 6, 7*a*, 7*b*. The roll 6 in the middle is a so-called spreader roll, and it is positioned on a different level of height with respect to the guide rolls 7*a*, 7*b* positioned on different sides of the same in such a manner that the wrap angle (the wrap angle being the angle formed between entrance and exit points of the paper web, i.e. the angle corresponding to the contact surface, the angular point of which is located in the fulcrum of the spreader roll 6) exerted on the paper web PR by the spreader roll 6 remains substantially constant. In view of saving space, it is advantageous that the spreader roll 6 is located on a lower level of height when compared to the level of height of the guide rolls 7*a*, 7*b*. An essential aspect in view of the method according to the invention is that the guide roll 7*a* of the roll assembly T, located before the first press device arrangement 8, and the first press device arrangement 8 are formed as separate units. In the second end 1*b* of the reeling plane 1, the reel-up comprises a stationary final reeling station LR, which comprises a second drive device 12 and fixing jaws 14. The paper web PR is immediately guided into a nip contact N1 in the first press device arrangement 8 via the roll assembly T which is stationary with respect to the frame of the reel-up FIGS. 1*a* to 1*e* describe, for example, the main characteristics of the reel change process according to the invention. FIG. 1*a* presents the stage in which the paper reel 5 that is being formed is reeled around a reeling core 10 which is driven by a first drive device 9 and connected to the reeling carriage 4, at the same time being substantially transferred in the travel direction of the paper web and, correspondingly, in the longitudinal direction of the frame of the reel-up on the reeling plane 1 (arrow S) away from the reel change station (point RV in FIG. 1*c*) towards the final reeling station LR in the second end of the reeling plane. Thus, the first drive device 9 is arranged to move along with the reeling carriage 4. As can be seen in FIGS. 1*c* to *e*, part of the reeling up process, the so-called initial reeling, is conducted in the reel change station RV, wherein the reeling carriage 4 and the reeling core therein are stationary with respect to the frame of the reel-up, whereafter the next step is a transfer stage according to FIG. 1*a* in the direction of arrow S. During the initial reeling (FIGS. 1*c* to *e*) and the transfer process (FIG. 1*a*) the first press device arrangement 8 is constantly in the first nip contact N1 with the paper reel 5 that is being formed, and the direction of the force produced by the nip contact considerably deviates from the direction of motion of said transfer. Thus, the dependency of the force effecting the nip contact and the transfer is small and reduces the disturbance factors in the control of the nip loading. Furthermore, the motion of the first press device arrangement is arranged to be linear, wherein when the reel grows, the effect of the changing geometry on the nip force is minimized.

Figure 1B:
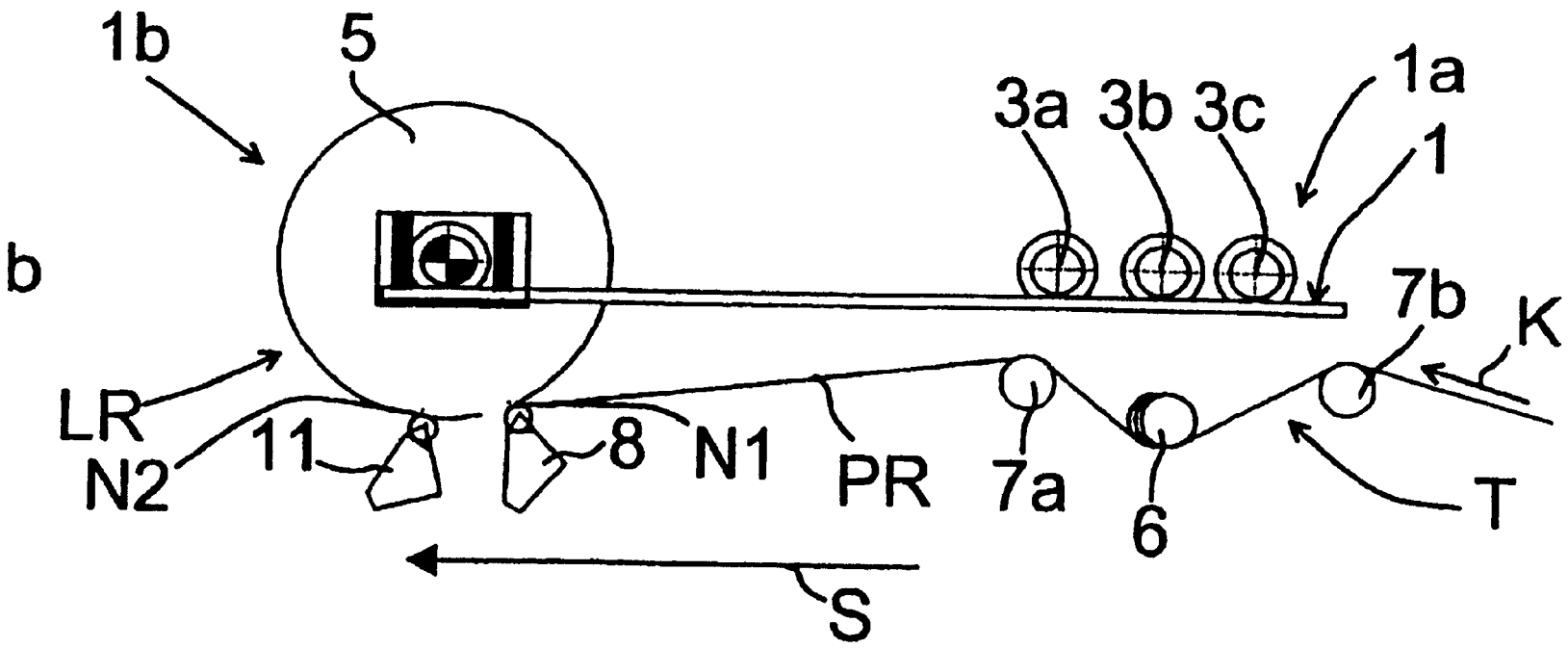
Figure 1C:
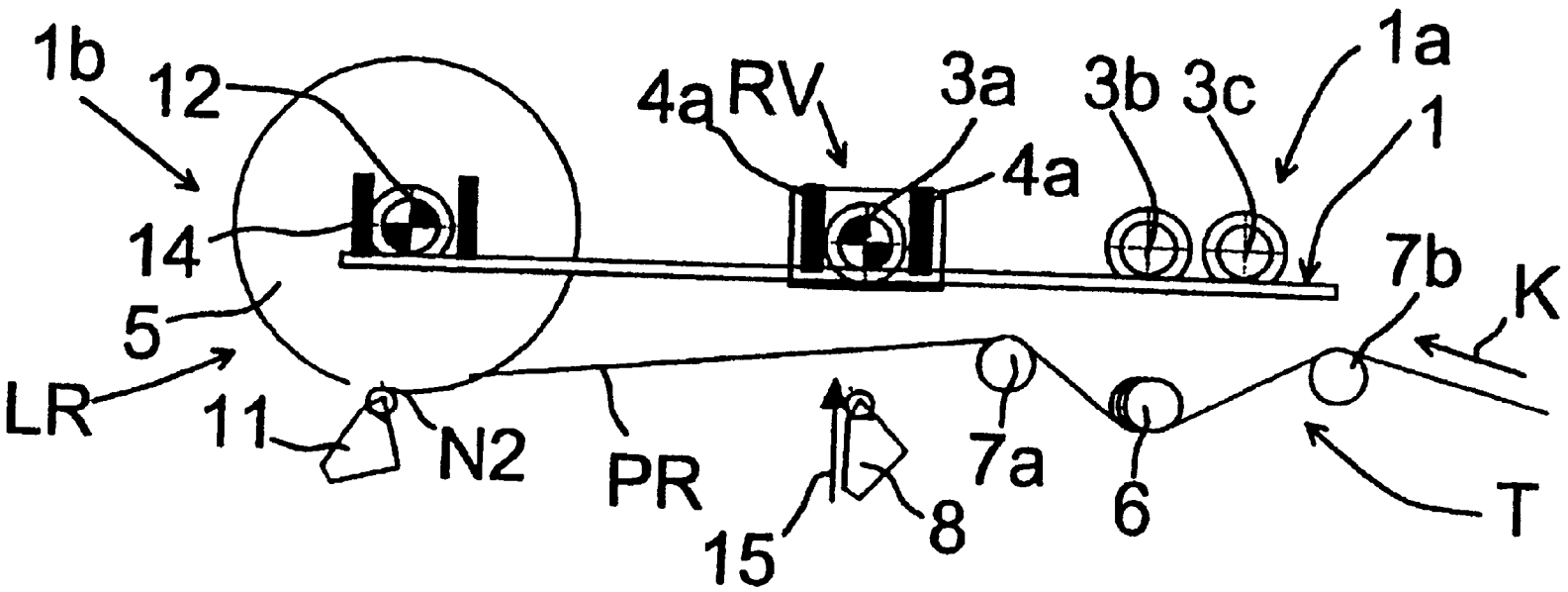
Figure 1D:
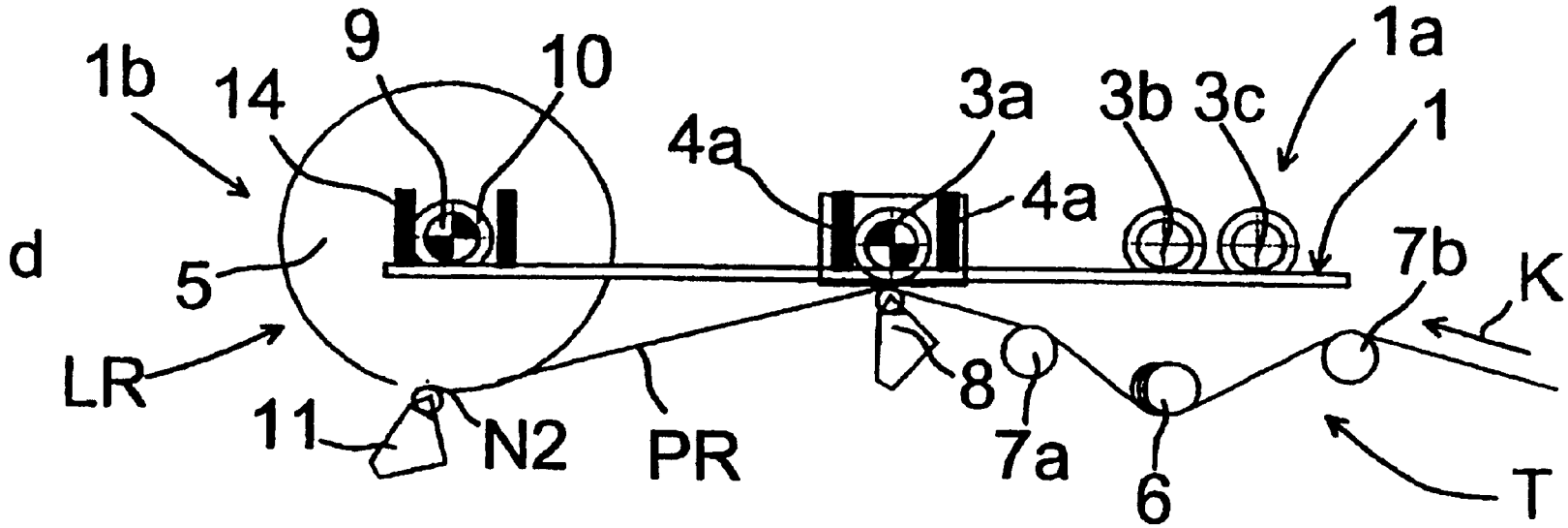
Figure 1E:
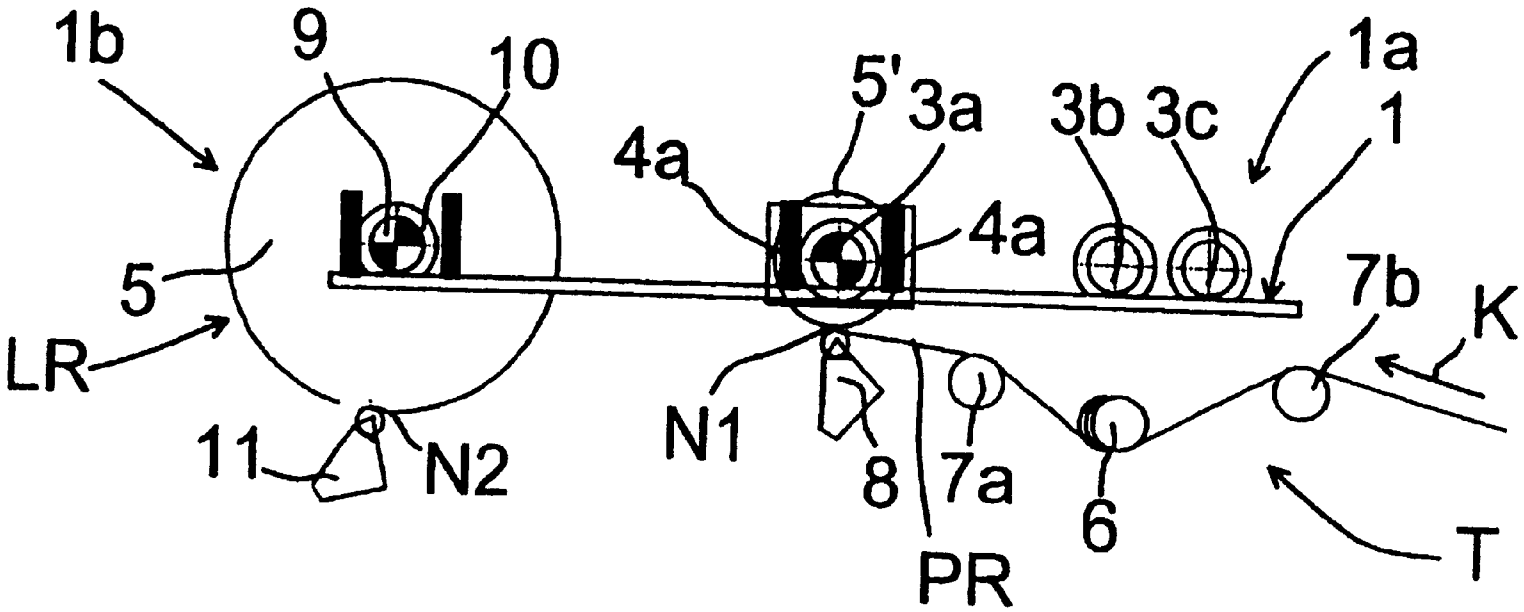

FIG. 1*b* shows a stage in which the transfer stage of the paper reel 5 that is being formed is finished, and a second nip contact N2 with a second press device arrangement has been established, wherein the first press device arrangement 8 is still in the first nip contact N1 with the paper reel 5 that is being formed. According to the embodiment of the presented method, the nip contact N1 is detached at this stage, the reeling core 10 is connected to the second drive device 12, the first drive device 9 is released from the reeling core 10, the fixing jaws 4*a* of the reeling carriage 4 are released and replaced with second fixing jaws 14 located in the stationary final reeling station LR. The above-presented stages are conducted at least partly simultaneously, or in stages according to the embodiment of the method.

FIG. 1*c* shows a stage in which the reeling carriage 4 is transferred to the reel change station RV, and a new reeling core 3*a* has been taken from the reeling core storage 2 on the support of the reeling carriage 4, and connected to the first drive 9 in the reeling carriage 4. The first press device arrangement 8 is also transferred by the reel change station RV, wherein the paper web PR travels below the reeling plane 1 and the reeling carriage 4 and above the first press device arrangement 8, i.e. between the aforementioned parts to the paper reel 5 at the final reeling up stage in the final reeling station LR, when the second press device arrangement 11 is in the second nip contact N2 with the paper reel 5. According to the invention, the new reeling core can be brought to the actual reel change station without affecting the travel of the web to the full reel in the final reeling station LR in any way.

FIG. 1*d* shows the starting stage of the actual reel change, wherein the reeling core 3*a*, which is located in the reeling carriage 4 is already accelerated to the web speed of the paper web by means of the first drive device 9, and the first press device arrangement 8 is transferred upwards in accordance with arrow 15 into the first nip contact N1 with the paper reel PR and the reeling core 3*a*. When the paper reel 5 at the final reeling station LR has become full, the paper web,PR is cut and a reel change to a new reeling core 3*a* is conducted according to FIG. 1*e* by means of a reel change device (not shown). The paper reel formed on the new reeling core 3*a* is marked with the reference numeral 5' in FIG. 1*e*. In the situation according to FIG. 1*e*, both the first 8 and the second 11 press device arrangement are in nip contacts N1 and N2 with corresponding paper reels 5 (the preceding one) and 5' (the new one).

In the situation of FIG. 1*e*, the stopping of the paper reel 5 located in the final reeling station LR is started e.g. by utilizing the second drive 12 and/or the second press device arrangement 11. When the paper reel 5 is stopped, it is removed from the final reeling station LR. Thus, the new paper reel 5' has proceeded to the situation of FIG. 1*a* in the transfer direction according to arrow S.

In the above-described manner it is possible to achieve a continuous reeling up process.

Figure 2:
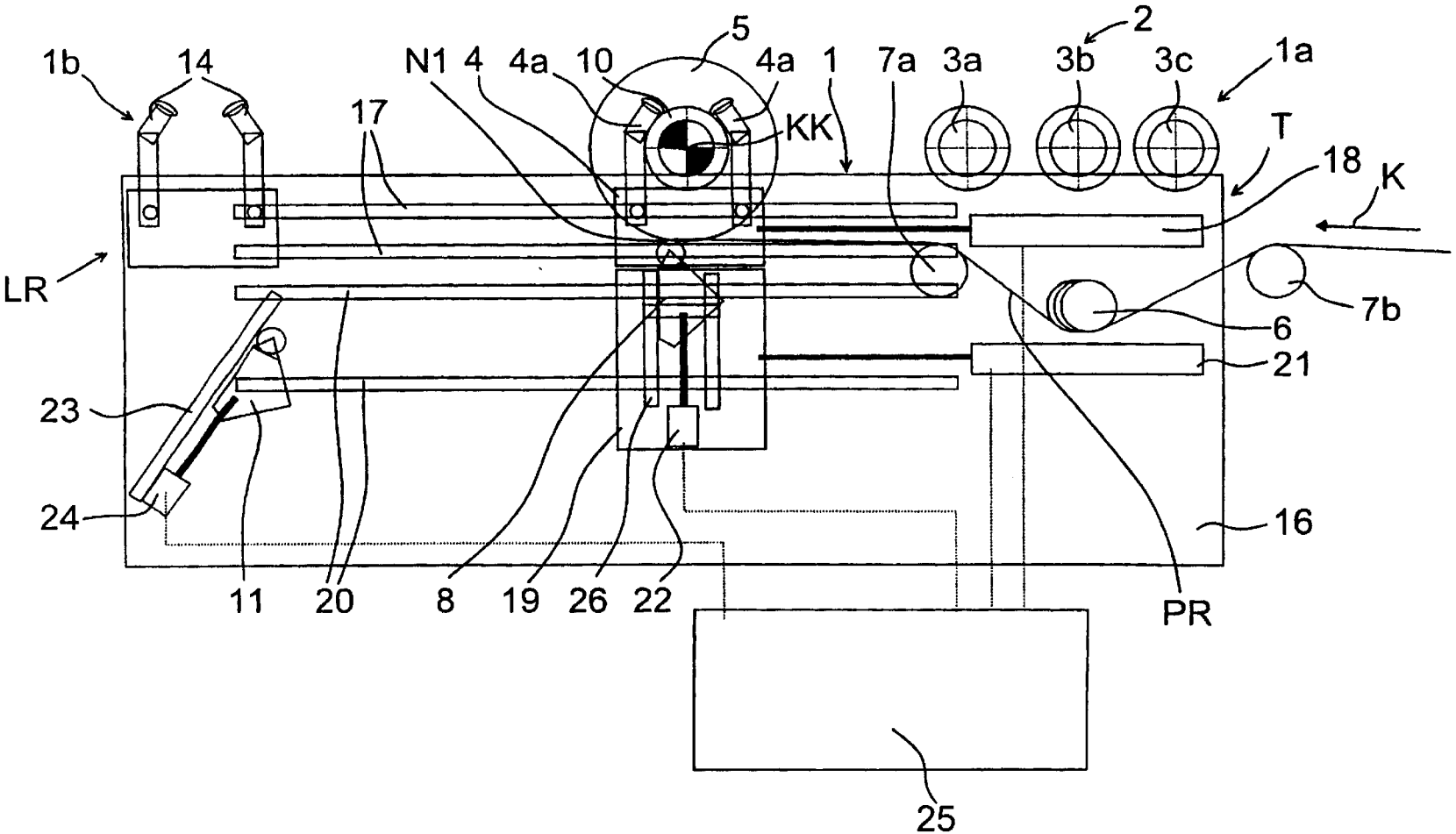
FIG. 2 shows an apparatus applying the method according to the invention in a schematical side-view.

FIG. 2 shows a schematical side-view of the apparatus applying the method according to the invention. In FIG. 2, similar reference numerals indicate the parts corresponding to the parts shown in connection with FIGS. 1*a* to *e*. The apparatus contains a frame 16, on the upper surface of which there is a horizontal reeling plane 1 and a reeling core storage 2. The reeling core storage 2 is positioned on top of the roll assembly T and substantially on a horizontal plane, on which the fulcrum of each reeling core 10, 3*a*, 3*b*, 3*c* . . . moves during the reeling process.

As can be seen in FIG. 2 as well as in FIG. 1, the first press device arrangement 8 is placed substantially in such a manner with respect to the paper reel 5 that is being formed that the first nip contact N1 is established underneath the fulcrum KK of the reeling core in question, preferably close by or in touch with the vertical line that runs via the fulcrum KK of the reeling core. The reeling carriage 4 is supported in such a manner that it moves on a horizontal guide assembly 17 stationary with respect to the frame 16 of the reel-up. The reeling carriage 4 moves on the support of the guide assembly 17 by means of first drive devices 18. The first press device arrangement 8 establishing the first nip contact N1, in turn, is arranged to move along with the reeling carriage 4. In the embodiment of FIG. 2, the first press device arrangement is fixed to an auxiliary frame 19, which, in turn, is placed on the support of a horizontal guide assembly 20 in the frame 16 of the reel-up. For the first press device arrangement 8 two actuators are arranged, of which the first actuator 21 is arranged to transfer the first press device arrangement 8 in the longitudinal direction of the reel-up, i.e. substantially in the horizontal direction, and the second actuator 22, which is arranged in connection with the auxiliary frame 19, transfers the first press device arrangement 8 substantially perpendicularly in the longitudinal direction of the frame of the reel-up, i.e. substantially in the vertical direction.

In the embodiment according to FIG. 2, the reeling carriage 4 and the first press device arrangement 8 are provided with separate actuators 18 and 21, respectively, so that they can be transferred as a combination in the longitudinal direction of the frame 16 of the reel-up. It is obvious, that the reeling carriage 4 and the first press device arrangement 8, especially its auxiliary frame 19 can be formed as a continuous frame structure, wherein it can be transferred by means of one actuator in the longitudinal direction of the frame of the reel-up. The advantage attained by means of the solution shown in FIG. 2 is that the point of location of the first nip contact N1 on the periphery of the paper reel 5 that is being formed can be transferred in the direction of the periphery of the paper reel formed by means of a temporary difference in the speed of motion of the actuators 18 and 21. Especially for the purpose of moving the first press device arrangement 8 in the vertical direction, the first press device arrangement is connected on the support of a vertical guide assembly 26 in the auxiliary frame 19, wherein the second actuator 22 is connected between the auxiliary frame 19 and the second press device arrangement 8.

The second press device arrangement 11, in turn, is placed on the other end 1*b* of the supporting plane 1 to receive the paper reel 5 that is being formed and to form a second nip contact N2 from a direction opposite to the direction of motion of the paper reel 5 that is being formed. The second press device arrangement 11 is arranged to move by means of an actuator 24 with respect to the frame 16 of the reel-up in a diagonally vertical direction in a guide arrangement 23 located in connection with the frame. The reel-up is provided with a computer 25, which is arranged to control the actuators of the reeling carriage 4 and the actuators of the first 8 and the second press device arrangement 11.

In detail, the method according to the invention proceeds in the following order of stages:

A) the reeling core 10 is placed in connection with the first fixing jaws 4*a* in the reeling carriage 4 in the reel change station RV when the paper web runs without touching the reeling core 10, B) the reeling core 10 is brought to the web speed of the paper web PR by means of the first drive 9, and the paper web PR is brought in connection with the reeling core 10 by means of the first press device arrangement 8, C) the paper web PR is cut, the cut end of the paper web is guided to the reeling core 10, and the reeling up process is started, D) the first nip contact N1 is maintained by means of the first press device arrangement 8, E) the paper reel 5 that is being formed is transferred in a position controlled manner substantially in the travel direction of the paper web PR, F) the paper reel 5 that is being formed is brought into the second nip contact N2 with the second press device arrangement, G) the reeling core 10 is placed in contact with the second stationary fixing jaws 14, and the first fixing jaws 4*a* are detached, H) the first drive 9 of the reeling core 10 is replaced with a second drive 12, I) the reeling carriage 4 and the first press device arrangement 8 are returned to receive a new reeling core 3*a* according to the stage A), J) the full paper reel is stopped after the reel change by utilizing the deceleration of the second drive 12, K) the full paper reel is removed from the reel-up.

The initial reeling is conducted in the reel change station RV by keeping the reeling core stationary with respect to the frame 16 of the reel-up. The final reeling, in turn, is conducted in connection with the second press device arrangement 11 in the final reeling station LR by keeping the reeling core 10 stationary with respect to the frame 16 of the reel-up. Between the processes of initial reeling and final reeling, the paper reel 5 that is being formed is transferred in a position controlled manner in the travel direction of the paper web PR. The distance from the reel, change station is adjusted by means of predetermined parameters in the following position controlled manner:

$A=f(n_k)$, $E=f(n_l)$, and $L=f(n_m)$, in which

A=the initial reeling

E=distance

L=final reeling n=set of parameters k=parameters used in the initial reeling A l=parameters used in determining the distance E m=parameters used in the final reeling L, wherein the parameters (k, m, l) equal the set of parameters n or subsets of the set of parameters n, wherein n contains at least the following parameters: web speed of the paper web, web tension of the paper web, nip contact force, diameter of the paper reel.

By means of the firs nip contact, a so-called reeling nip is established, by means of which the quality of the paper reel that is being formed is substantially affected. The second nip contact N2 and thus the second press device arrangement 11 are arranged to be used at the final stage of the reeling up process to discharge air from between the paper web layers.

What is claimed is:

1. A method in a reeling process of a paper web, comprising the steps of:

continuously reeling a paper web (PR) around an exchangeable reeling core (10) rotating with respect to the frame (16) of a reel-up applying the reeling process, guiding the paper web (PR) to said reeling core (10) via a roll assembly (T), arranging a first press device arrangement (8) to move with respect to the frame (16) of the reel-up, maintaining a first nip contact (N1) to the paper web (PR) that is being formed on the reeling core by means of the first press device arrangement (8), and transferring the first press device arrangement (8) with respect to the frame (16) of the reel-up, bringing the paper reel (5) formed on the reeling core (10) into a second nip contact (N2) with the second press device arrangement (11) by maintaining the nip contact (N1) established by the first press device arrangement (8), constructing the section of the roll assembly (T) before the first press device arrangement (8) and the first press device arrangement (8) as separate units, guiding the paper web (PR) via the roll assembly (T) immediately into nip contact (N1) in the first press device arrangement (8), transferring the paper reel (5) that is being formed and the first press device assembly as a combination substantially in the travel direction of the paper web (PR) in a position controlled manner, and maintaining the roll assembly (T) that guides the paper web (PR) immediately into nip contact (N1) in the first press device arrangement (8) stationary with respect to the frame (16) of the reel-up.

2. The method according to claim 1, further comprising maintaining a wrap angle exerted on the paper web (PR) by a spreader roll (6) belonging to the roll assembly (T), substantially constant.

3. The method according to claim 1, further comprising placing at least one guide roll (7*a*) belonging to the roll assembly (T) between a spreader roll (6) and the first press device arrangement (8).

4. The method according to claim 1, further comprising positioning a reeling core storage (2) substantially on top of the roll assembly (T), substantially on the horizontal plane, on which the fulcrum of the reeling core (10) is transferred during the reeling process.

5. The method according to claim 1, transferring the first press device arrangement (8) in the vertical direction.

6. The method according to claim 1, further comprising arranging a second press device arrangement (11) to receive the paper reel (5) formed on the reeling core from a direction opposite to the direction of motion of the paper reel (5).

7. The method according to claim 1, wherein the nip contact (N1, N2) is established by the first (8) and/or second (11) press device arrangement vertically right below the fulcrum of the reeling core (10).

8. The method according to claim 1, wherein the reeling core (10) is equipped with a centre-drive (9, 12) and that the second press device arrangement (11) is used in the discharge of air at the final stage of the reeling up process.

9. The method according to claim 1, wherein the first (8) and the second (11) press device arrangements are utilized to maintain a double nip contact for a set period of time in connection with the change of the nip contacts (N1; N2).

10. The method according to claim 1, wherein the first press device arrangement (8) is mechanically connected to a reeling carriage (4) of the reeling core (10) to follow the motion of the reeling carriage (4).

11. The method according to claim 1, wherein the first press device arrangement (8) is transferred along with a reeling carriage (4) of the reeling core (10) by means of independent position control.

12. The method according to claim 1, wherein a first drive (9) of the reeling core (10) and first fixing jaws (4*a*), are positioned in connection with a reeling carriage (4) and the second drive (12) and second fixing jaws (14), are positioned in connection with the second press device arrangement (11) in a stationary final reeling station (LR).

13. The method according to claim 1, wherein the first press device arrangement (8) is used to load the paper reel (5) formed on the reeling core (10).

14. The method according to claim 1, wherein

A) the reeling core (10) is placed in connection with first fixing jaws (4*a*) in a reeling carriage (4) in a reel change station (RV) when the paper web runs without touching the reeling core (10), B) the reeling core (10) is brought to the web speed of the paper web (PR) by means of a first drive (9), and the paper web (PR) is brought in connection with the reeling core (10) by means of the first press device arrangement (8), C) the paper web (PR) is cut, the cut end of the paper web is guided to the reeling core (10), and the reeling up process is started, D) the first nip contact (N1) is maintained by means of the first press device arrangement (8), E) the paper reel (5) that is being formed is transferred in a position controlled manner substantially in the travel direction of the paper web (PR), F) the paper reel (5) that is being formed is brought into the second nip contact (N2) with the second press device arrangement, G) the reeling core (10) is placed in contact with second stationary fixing jaws (14), and the first fixing jaws (4*a*) are detached, H) the first drive (9) of the reeling core (10) is replaced with a second drive (12), I) the reeling carriage (4) and the first press device arrangement (8) are returned to receive a new reeling core (3*a*) according to the stage A), J) the full paper reel is stopped after the reel change by utilizing the deceleration of the second drive (12), K) the full paper reel is removed from the reel-up.

15. The method according to claim 14, wherein the first press device arrangement (8) is returned to the reel change station (RV) in the horizontal direction, wherein the paper web (PR) is guided to travel below the reeling carriage (4) to be returned and above the first press device arrangement (8).

16. The method according to claim 14, wherein the initial reeling is conducted in the reel change station (RV) by keeping the reeling core (10) stationary with respect to the frame (16) of the reel-up, that the final reeling is conducted in connection with the second press device arrangement (11) in a final reeling station (LR) by keeping the reeling core (10) stationary with respect to the frame (16) of the reel-up, and that the paper reel (5) that is being formed is transferred in a position controlled manner in the travel direction of the paper web between the initial reeling and the final reeling.

17. The method according to claim 1, wherein the distance from the reel change station (RV) is adjusted according to predetermined parameters in the following position controlled manner:

$A=f(n_k)$, $E=f(n_j)$, and $L=f(n_m)$, in which

A=initial reeling

E=distance

L=final reeling n=set of parameters k=parameters used in the initial reeling A l=parameters used in determining the distance E m=parameters used in the final reeling L, wherein the parameters (k, m, l) equal the set of parameters n or subsets of the set of parameters n, wherein n contains at least the following parameters: web speed of the paper web, web tension of the paper web, nip contact force, diameter of the paper reel.

18. The method according to claim 1, wherein a reeling core storage (2) is arranged, the paper reel (5) that is being formed is transferred in the longitudinal direction of the reel-up, and the paper reel (5) is stopped on the same horizontal plane.

19. The method according to claim 1, wherein the full paper reel on the reeling core (10) is maintained in the second nip contact (N2) with the second press device arrangement (11), wherein the rotation of the full paper reel is stopped.

20. A reel-up in which a paper web (PR) is arranged to be reeled continuously around an exchangeable reeling core (10) rotating with respect to the frame (16) of the reel-up and is connected to a reeling carriage (4), comprising a roll assembly (T) via which the paper web (PR) is arranged to be guided to the reeling core (10), a first (8) and a second (11) press device arrangement, which are arranged to establish a first (N1) and a second (N2) nip contact with the paper reel that is reeled on the reeling core (10), a reeling core storage (2), and drive devices (9, 12) for rotating the reeling core (10), wherein the reeling core (10) and the paper reel (5) reeled thereon are arranged to be transferred in the longitudinal direction of the reel-up, maintaining a nip contact (N1) with the first press device arrangement, in contact with the second press device arrangement (11), the section of the roll assembly (T) before the first press device arrangement, and the first press device arrangement (8) are formed as separate units, the first press device arrangement (8) is arranged to directly receive the paper web passed from the roll assembly, the first drive device of the reeling core (10) is connected to the reeling carriage (4) to rotate the paper reel (5) that is being formed when the paper reel (5) that is being formed and the first press device arrangement (8) are transferred as a combination in the longitudinal direction of the reel-up, and the second press device arrangement (11) is provided with a second drive device (12) which is arranged to be used at the final stage of the formation of the paper reel (5), wherein the roll assembly (T) is formed stationary with respect to the frame (16) of the reel-up.

21. The reel-up according to claim 20, wherein the second drive device (11) is provided with a fixing jaw arrangement (14) for fixing the reeling core (10) in connection with the second press device arrangement (11).

22. The reel-up according to claim 20, wherein on both sides of a spreader roll (6) belonging to the roll assembly (T) there are guide rolls (7*a*, 7*b*) stationary with respect to the frame (16) of the reel-up, to maintain the wrap angle exerted by the spreader roll (6) on the paper web (PR) constant.

23. The reel-up according to claim 20, wherein the reeling core storage (2) is placed on top of the roll assembly (T), and substantially on the horizontal plane, on which the fulcrum of the reeling core (10) moves during the reeling process.

24. The reel-up according to claim 20, wherein the first press device arrangement (8) is arranged substantially in such a manner with respect to the paper reel (5) that is being formed, that the first nip contact (N1) is formed below the fulcrum (KK) of the reeling core (10), preferably close by or in touch with the vertical line which travels via the fulcrum (KK) of the reeling core (10).

25. The reel-up according to claim 20, wherein the second press device arrangement (11) is placed in such a manner that it establishes the second nip contact (N2) from a direction opposite to the direction of motion of the paper reel (5) that is being formed.

26. The reel-up according to claim 20, wherein the reeling carriage (4) is supported to move on the support of a guide assembly (17) stationary with respect to the frame (16) of the reel-up, that the reeling carriage (4) comprises a first drive device (9), that the reeling carriage (4) is provided with fixing jaws (4*a*) for fixing the reeling core (10) in connection with the reeling carriage, and that the first press device arrangement (8) establishing the first nip contact (N1) is arranged to move along with the reeling carriage (4) by means of at least one actuator (21, 22).

27. The reel-up according to claim 20, wherein for the first press device arrangement (8) two actuators (21, 22) are arranged, of which the first actuator (21) is arranged to transfer the first press device arrangement (8) in the longitudinal direction of the reel-up, i.e. substantially in the horizontal direction, and the second actuator (22) substantially in a direction perpendicular to the longitudinal direction of the reel-up, i.e. substantially in the vertical direction.

28. The reel-up according to claim 20, wherein the reeling carriage (4) and the first press device arrangement (8) are provided with separate actuators (18; 21) to transfer them as a combination in the longitudinal direction of the frame (16) of the reel-up.

29. The reel-up according to claim 20, wherein the reeling carriage (4) and the first press device arrangement (8) share an actuator for transferring them as a combination in the longitudinal direction of the reel-up.

30. The reel-up according to claim 20, wherein the first press device arrangement (8) is provided with a preferably vertical guide arrangement to transfer the first press device arrangement (8) by means of a second actuator 22 along with the paper reel (5) that is being formed in the vertical direction with respect to a structural part (reeling carriage (4) or an auxiliary frame (19) of the first press device arrangement (8), traveling along with the reeling carriage).

31. The reel-up according to claim 20, wherein the second press device arrangement (11) is arranged to move by means of an actuator (24) with respect to the frame of the reel-up in a guide arrangement (23) located in connection with the frame.

32. The reel-up according to claim 20, wherein there is a computer (25) in connection with the reel-up, which is arranged to guide actuators of the reeling carriage (4) and actuators of the first (8) and the second (11) press device arrangement.

* * * * *